US005723244A

United States Patent [19]

Chamberlain et al.

[11] Patent Number: 5,723,244

[45] Date of Patent: Mar. 3, 1998

[54] CHARGING NEUTRALIZATION PROCESSES

[75] Inventors: Scott D. Chamberlain, Macedon; Christopher M. Knapp, Fairport; David H. Pan, Rochester, all of N.Y.

[73] Assignee: Xerox Corporation, Stamford, Conn.

[21] Appl. No.: 867,658

[22] Filed: Jun. 2, 1997

[51] Int. Cl.[6] ..... G03G 21/06

[52] U.S. Cl. ..... 430/97; 430/31

[58] Field of Search ..... 430/31, 97

[56] References Cited

U.S. PATENT DOCUMENTS

| | | | |
|---|---|---|---|
| 4,707,429 | 11/1987 | Trout | 430/115 |
| 4,897,333 | 1/1990 | Matsushita | 430/31 |
| 5,026,621 | 6/1991 | Tsubuko et al. | 430/109 |
| 5,030,535 | 7/1991 | Drappel et al. | 430/116 |
| 5,035,972 | 7/1991 | El-Sayed et al. | 430/114 |
| 5,045,425 | 9/1991 | Swidler | 430/115 |
| 5,366,840 | 11/1994 | Larson et al. | 430/115 |
| 5,563,015 | 10/1996 | Bonsignore et al. | 430/106 |
| 5,622,798 | 4/1997 | Kimoto | 430/97 |
| 5,627,002 | 5/1997 | Pan et al. | 430/115 |

*Primary Examiner*—Roland Martin

*Attorney, Agent, or Firm*—E. O. Palallo

[57] ABSTRACT

A process for the reduction of residual image voltage present on an imaging member which comprises contacting the member with a composition comprised of a nonpolar liquid, thermoplastic resin particles, an optional charge adjuvant, charge control additive, carbon black pigment, and a charge director comprised of a nonpolar liquid soluble organic aluminum complex, or mixtures thereof of the formulas

II.

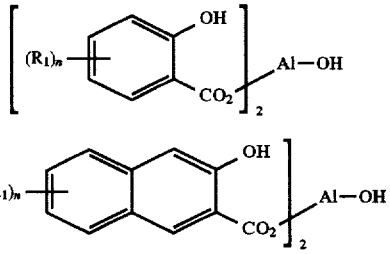

wherein $R_1$ is selected from the group consisting of hydrogen and alkyl, and n represents a number, and wherein said voltage is reduced to from about zero to about 25 volts.

23 Claims, No Drawings

CHARGING NEUTRALIZATION PROCESSES

PATENTS

U.S. Pat. No. 5,563,015, the disclosure of which is totally incorporated herein by reference, illustrates imaging processes and a positively charged liquid developer comprised of a nonpolar liquid, thermoplastic resin particles, an optional charge adjuvant, optional pigment, and a charge director comprised of a mixture of I. a nonpolar liquid soluble organic phosphate mono and diester mixture derived from phosphoric acid and isotridecyl alcohol, and II. a nonpolar liquid soluble organic aluminum complex, or mixtures thereof of the formulas

I.

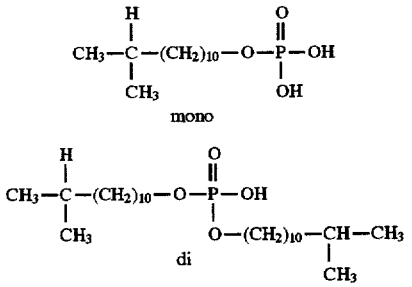

II.

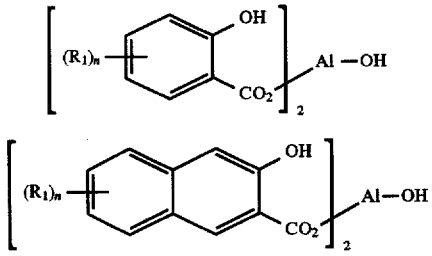

wherein $R_1$ is selected from the group consisting of hydrogen and alkyl, and n represents a number.

Illustrated in U.S. Pat. No. 5,627,002, the disclosure of which is totally incorporated herein by reference are, for example, liquid developers with cyclodextrin charge additives.

BACKGROUND OF THE INVENTION

This invention is generally directed to liquid developer compositions and, more specifically, the present invention relates to processes for neutralization, or reducing the voltage, especially the residual voltage present on substrates, such as ionographic and photoconductive imaging members. Voltage reductions, especially in four pass xerographic imaging color systems, such as the Xerox Corporation ColorgrafX 8900 series of printers, permits, for example, continued excellent image resolution, superior color resolution, and excellent image density. In embodiments of the present invention, an ionographic imaging member is contacted with a composition comprised of a nonpolar liquid, thermoplastic resin, certain colorants, such as pigments, preferably black pigments like REGAL 330® carbon black obtained from Cabot Corporation, charge additive, such as a cyclodextrin, and a charge director, wherein the residual voltage thereof is reduced from about a negative 140 volts to about zero to about a negative 10 volts. With the processes of the present invention, there is enabled a number of advantages as illustrated herein including specifically the minimization or elimination of overlaying, the minimization or elimination of staining, neutralization of the member, and the like. More specifically, the present invention relates to a process for the neutralization of charges or a voltage on an imaging substrate by contacting the substrate with a positively charged liquid developer comprised of a nonpolar liquid, carbon black pigment, thermoplastic resin, charge additive, and a charge director, and more specifically, a charge director of organic aluminum complexes of the formulas illustrated herein, wherein $R_1$ is selected from the group consisting of hydrogen and alkyl; wherein alkyl, for example, contains from 1 to about 12 carbon atoms, and n represents a number, such as 1, 2, 3, or 4; and wherein the preferred aluminum complex in embodiments is an aluminum-di-tertiary-butyl salicylate.

For image quality, solid area coverage and resolution of developed images one usually desires, for example, sufficient toner particle electrophoretic mobility. The mobility for effective image development is primarily dependent on the imaging system used, and this electrophoretic mobility is directly proportional to the charge on the toner, or solid particles of resin, pigment, and charge additive, and inversely proportional to the viscosity of the liquid developer fluid. For example, an about 10 to 30 percent change in fluid viscosity can cause for instance an about 5° C. to 15° C. (Centigrade) decrease in temperature, could result in a decrease in image quality, poor or unacceptable image development, and undesirable image background development, for example, because of a 5 percent to 23 percent decrease in electrophoretic mobility. Insufficient particle charge can also result in poor, or no transfer of the developer or toner to paper, or other substrates. Poor transfer, for example, can result in poor image solid area coverage if insufficient toner is transferred to the final substrate, and can also result in image defects such as smearing and hollowed fine features.

A latent electrostatic image can be developed with toner particles dispersed in an insulating nonpolar liquid. The aforementioned dispersed materials are known as liquid toners or liquid developers. A latent electrostatic image may be generated by providing a photoconductive layer with a uniform electrostatic charge and subsequently discharging the electrostatic charge by exposing it to a modulated beam of radiant energy. Other methods are also known for forming latent electrostatic images, such as, for example, providing a carrier with a dielectric surface and transferring a preformed electrostatic charge to the surface. After the latent image has been formed, the image is developed by colored toner particles dispersed in a nonpolar liquid. The image may then be transferred to a receiver sheet. Also known are ionographic imaging systems.

Typical liquid developers can comprise a thermoplastic resin, optional pigment, and a dispersant nonpolar liquid. Generally, a suitable colorant, such as a dye or pigment, is also present in the developer. The colored toner particles are dispersed in a nonpolar liquid which generally has a high volume resistivity in excess of about $10^9$ ohm-centimeters, a low dielectric constant, for example below 3.0, and a high vapor pressure. Generally, the toner particles are less than about 10 μm (microns) average by area size as measured with the Horiba 700 Particle Sizer.

Since the formation of proper images depends primarily on the difference of the charge between the toner particles in the liquid developer and the latent electrostatic image to be developed, it is desirable to add a charge director compound and charge adjuvants, which increase the magnitude of the charge, such as polyhydroxy compounds, amino alcohols, polybutylene succinimide compounds, aromatic hydrocarbons, metallic soaps, and the like, to the liquid developer comprising the thermoplastic resin, the nonpolar liquid and the colorant. A charge director can be of importance in controlling the charging properties of the toner to enable excellent quality images.

PRIOR ART

In U.S. Pat. No. 5,035,972, the disclosure of which is totally incorporated herein by reference, there are illustrated liquid developers with quaternized ammonium AB diblock copolymer charge directors, and wherein the nitrogen in the ionic A block is quaternized with an alkylating agent.

U.S. Pat. No. 5,019,477, the disclosure of which is hereby totally incorporated by reference, discloses a liquid electrostatic developer comprising a nonpolar liquid, thermoplastic resin particles, and a charge director. The ionic or zwitterionic charge directors may include both negative charge directors such as lecithin, oil-soluble petroleum sulfonate and alkyl succinimide, and positive charge directors such as cobalt and iron naphthenates.

U.S. Pat. No. 5,030,535 discloses a liquid developer composition comprising a liquid vehicle, a charge control additive and toner particles. The toner particles may contain pigment particles and a resin selected from the group consisting of polyolefins, halogenated polyolefins and mixtures thereof.

U.S. Pat. No. 5,026,621 discloses a toner for electrophotography which comprises as main components a coloring component and a binder resin of, for example, a block copolymer comprising a functional segment (A) consisting of at least one of a fluoroalkylacryl ester block unit or a fluoroalkyl methacryl ester block unit, and a compatible segment (B) consisting of a fluorine-free vinyl or olefin monomer block unit.

In U.S. Pat. No. 4,707,429 there are illustrated, for example, liquid developers with an aluminum stearate charge adjuvant. Liquid developers with, for example, certain aluminum salicylates as charge directors are illustrated in U.S. Pat. No. 5,045,425. The aluminum salicylates of the '425 patent, the disclosure of which is totally incorporated herein by reference, can be selected as the charge director for the liquid developers and processes of the present invention.

Stain elimination in consecutive colored liquid toners is illustrated in U.S. Pat. No. 5,069,995.

In U.S. Pat. No. 5,306,591 and U.S. Pat. No. 5,308,731, the disclosures of which are totally incorporated herein by reference, there is illustrated a liquid developer comprised of thermoplastic resin particles, a charge director, and a charge adjuvant comprised of an imine bisquinone; and a liquid developer comprised of a liquid, thermoplastic resin particles, a nonpolar liquid soluble charge director, and a charge adjuvant comprised of a metal hydroxycarboxylic acid, respectively. In Statutory Invention Registration No. H1483, the disclosure of which is totally incorporated herein by reference, there is illustrated a liquid developer comprised of thermoplastic resin particles, and a charge director comprised of an ammonium AB diblock copolymers In U.S. Pat. No. 5,366,840, the disclosure of which is totally incorporated herein by reference, there is illustrated a liquid developer comprised of thermoplastic resin particles, an optional charge director, and a charge additive or adjuvant, comprised of an aluminum complex.

SUMMARY OF THE INVENTION

Examples of objects of the present invention in embodiments include:

It is an object of the present invention to provide a liquid developer composition and processes with many of the advantages illustrated herein.

Another object of the present invention resides in the provision of a process for the charge, especially residual voltage, neutralization of ionographic members.

Further, another object of the present invention resides in the provision of a process for the charge, especially residual voltage, neutralization of layered photoconductive imaging members.

It is still a further object of the invention to provide processes wherein developed image defects such as smearing, loss of resolution and loss of density are eliminated, or minimized.

In embodiments, the present invention relates to compositions and processes for reducing the residual voltages on imaging members. More specifically, the present invention relates to a process which comprises contacting a charged imaging member with a composition comprised of a nonpolar liquid, thermoplastic resin, pigment, charge control additive, and a charge director, especially a charge director comprised of organic aluminum complexes, and which charge director is present in the liquid developer in an amount of from about 1 to about 1,000 milligrams of charge director per 1 gram of developer solids, wherein the developer solids are comprised of thermoplastic resin, pigment, and charge additive. The charged imaging member is usually charged to a negative voltage of from about 135 to about 175, and preferably about 140 volts, and this charge is reduced to from about zero to about 10 volts after being contacted with the composition illustrated herein. In embodiments, the composition comprises a nonpolar liquid, thermoplastic toner resin, charge adjuvant, carbon black pigment, and a charge director of an aluminum hydroxide, such as the aluminum salts of alkylated salicylic acid like, for example, hydroxy bis(3,5-tertiary butyl salicylic) aluminate, and which salts are illustrated in U.S. Pat. No. 5,366,840 mentioned herein, the disclosure of which is totally incorporated herein by reference.

Examples of specific aluminum charge directors selected, and present in various effective amounts as indicated herein and, for example, from about 0.1 to about 15, and preferably from about 1 to about 4 weight percent, based on the weight, for example, of all the composition components, include aluminum di-tertiary-butyl salicylate; hydroxy bis(3,5-tertiary butyl salicylic)aluminate; hydroxy bis(3,5-tertiary butyl salicylic) aluminate mono-, di-, tri- or tetrahydrates; hydroxy bis(salicylic)aluminate; hydroxy bis(monoalkyl salicylic)aluminate; hydroxy bis(dialkyl salicylic) aluminate; hydroxy bis(trialkyl salicylic)aluminate; hydroxy bis (tetraalkyl salicylic)aluminate; hydroxy bis(hydroxy naphthoic acid)aluminate; hydroxy bis(monoalkylated hydroxy naphthoic acid)aluminate; bis(dialkylated hydroxy naphthoic acid)aluminate wherein alkyl preferably contains 1 to about 6 carbon atoms; bis(trialkylated hydroxy naphthoic acid)aluminate wherein alkyl preferably contains 1 to about 6 carbon atoms; bis(tetraalkylated hydroxy naphthoic acid) aluminate wherein alkyl preferably contains 1 to about 6 carbon atoms; and the like.

In embodiments of the present invention, the composition selected for reducing the residual imaging member voltage, which member can be positively charged, is comprised a nonpolar liquid component, thermoplastic resin, REGAL 300® carbon black pigment, charge control additive, preferably a cyclodextrin, and the aluminum charge director illustrated herein.

Examples of nonpolar liquid carriers, or nonpolar liquids selected for the composition of the present invention include a liquid with an effective viscosity as measured, for example, by a number of known methods, such as capillary viscometers, coaxial cylindrical rheometers, cone and plate rheometers, and the like of, for example, from about 0.5 to about 500 centipoise, and preferably from about 1 to about 20 centipoise, and a resistivity equal to or greater than about $5\times10^9$ ohm/cm, such as $5\times10^{13}$. Preferably, the liquid selected is a branched chain aliphatic hydrocarbon as illustrated herein. A nonpolar liquid of the ISOPAR® series (available from Exxon Corporation) may also be selected for the developers of the present invention. These hydrocarbon liquids are considered narrow portions of isoparaffinic hydrocarbon fractions with extremely high levels of purity. For example, the boiling point range of ISOPAR G® is between about 157° C. and about 176° C.; ISOPAR H® is between about 176° C. and about 191° C.; ISOPAR K® is between about 177° C. and about 197° C.; ISOPAR L® is between about 188° C. and about 206° C.; ISOPAR M® is between about 207° C. and about 254° C.; and ISOPAR V® is between about 254.4° C. and about 329.4° C. ISOPAR L® has a mid-boiling point of approximately 194° C. ISOPAR M® has an auto ignition temperature of 338° C. ISOPAR G® has a flash point of 40° C. as determined by the tag closed cup method; ISOPAR H® has a flash point of 53° C. as determined by the ASTM D-56 method; ISOPAR L® has a flash point of 61° C. as determined by the ASTM D-56 method; and ISOPAR® M has a flash point of 80° C. as determined by the ASTM D-56 method. The liquids selected should have an electrical volume resistivity in excess of $10^9$ ohm-centimeters and a dielectric constant below 3.0. Moreover, the vapor pressure at 25° C. should be less than 10 Torr in embodiments. The amount of liquid carrier or nonpolar liquid selected is from about 75 to about 99.9 weight percent and preferably between 95 and 99 weight percent.

Although in embodiments the ISOPAR® series liquids can be the preferred nonpolar liquids, other suitable liquids may be selected such as the NORPAR® series available from Exxon Corporation, the SOLTROL® series available from the Phillips Petroleum Company, and the SHELLSOL® series available from the Shell Oil Company.

The amount of the liquid employed is, for example, from about 75 percent to about 99.9 percent, and preferably from about 95 to about 99 percent by weight of the total solids. The total solids components content is, for example, from about 0.1 to about 25 percent by weight, and preferably from about 1.0 to about 5 percent.

Typical suitable thermoplastic toner resins that can be selected for the compositions, and which resins are present in effective amounts of, for example, in the range of from about 99 percent to about 40 percent, and preferably from about 80 percent to about 40 percent of developer solids comprised of thermoplastic resin, carbon black pigment, charge adjuvant, and in embodiments other optional components, such as magnetic materials like magnetites, include ethylene vinyl acetate (EVA) copolymers, (ELVAX® resins, E. I. DuPont de Nemours and Company, Wilmington, Del.); copolymers of ethylene and an α-β-ethylenically unsaturated acid selected from the group consisting of acrylic acid and methacrylic acid; copolymers of ethylene (80 to 99.9 percent), acrylic or methacrylic acid (20 to 0.1 percent)/alkyl (C1 to C5) ester of methacrylic or acrylic acid (0.1 to 20 percent); polyethylene; polystyrene; isotactic polypropylene (crystalline); ethylene ethyl acrylate series available under the trademark BAKELITE® DPD 6169, DPDA 6182 NATURAL™ (Union Carbide Corporation, Stamford, Conn.); ethylene vinyl acetate resins like DQDA 6832 Natural 7 (Union Carbide Corporation); SURLYN® ionomer resin (E. I. DuPont de Nemours and Company); or blends thereof; polyesters; polyvinyl toluene; polyamides; styrene/butadiene copolymers; epoxy resins; acrylic resins, such as a copolymer of acrylic or methacrylic acid, and at least one alkyl ester of acrylic or methacrylic acid wherein alkyl is 1 to 20 carbon atoms, such as methyl methacrylate (50 to 90 percent)/methacrylic acid (0 to 20 percent)/ethylhexyl acrylate (10 to 50 percent); and other acrylic resins including ELVACITE® acrylic resins (E. I. DuPont de Nemours and Company); or blends thereof. Preferred copolymers selected in embodiments are comprised of the copolymer of ethylene and an α-β-ethylenically unsaturated acid of either acrylic acid or methacrylic acid. In a preferred embodiment, NUCREL® resins available from E. I. DuPont de Nemours and Company like NUCREL 599®, NUCREL 699®, or NUCREL 960® are selected as the thermoplastic resin. The preferred resin in embodiments is ethylene vinyl acetate (EVA) copolymers, (ELVAX® resins, E. I. DuPont de Nemours and Company, Wilmington, Del.).

The pigment REGAL 330® carbon black, or equivalent carbon black (Black Pearl L) is present in the composition in an effective amount of, for example, from about 0.1 to about 60 percent, and preferably from about 10 to about 40 percent by weight based on the total weight of solids. Examples of pigments which may be selected include certain carbon blacks available from, for example, Cabot Corporation (Boston, Mass.), such as REGAL 330® and Black Pearls L.

Charge adjuvants can be added to the compositions illustrated here and such adjuvants include metallic soaps like aluminum or magnesium stearate or octoate, fine particle size oxides, such as oxides of silica, alumina, titania, and the like, paratoluene sulfonic acid, and polyphosphoric acid, copolymers of an alkene and unsaturated acid derivatives, such as acrylic acid and methacrylic acid derivatives, containing pendant ammonium copolymers of ethylene and methacrylic acid esters with the ester groups having pendant ammonium groups, such as a copolymer of ethylene and N,N,N-trimethylammonium-2-ethylmethacrylate bromide, a copolymer of ethylene and N,N,N-trimethylammonium-2-ethylmethacrylate tosylate, a copolymer of ethylene and N,N-dimethylammonium-2-ethylmethacrylate hydrogen tosylate, a copolymer of ethylene and N,N-dimethylammonium-2-ethylmethacrylate hydrogen bromide, a copolymer of ethylene and N,N-dimethylammonium-2-ethylmethacrylate hydrogen dinonylnaphthalene sulfonate, and the like. The charge adjuvants can be added in an amount of from about 1 percent to about 100 percent of the total developer solids of toner resin, pigment, and charge adjuvant, and preferably from about 10 percent to about 50 percent of the total weight of solids. The preferred charge control additive is a cyclodextrin, reference U.S. Pat. No. 5,627,002, the disclosure of which is totally incorporated herein by reference.

Embodiments of the present invention include a process for the reduction of residual image voltage present on an imaging member, which comprises contacting the member with a composition comprised of a nonpolar liquid, thermoplastic resin particles, an optional charge adjuvant, charge control additive, carbon black pigment, and a charge director comprised of a nonpolar liquid soluble organic aluminum complex, or mixtures thereof of the formulas

II.

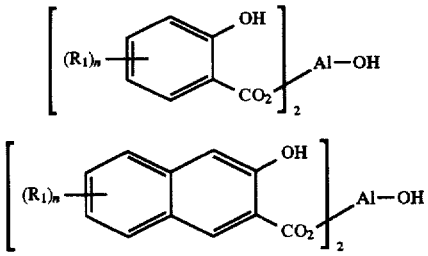

wherein $R_1$ is selected from the group consisting of hydrogen and alkyl, and n represents a number; a process wherein the charge control additive is beta-cyclodextrin; a process wherein the residual voltage is reduced from a negative 140 volts to from about a zero volts to about a negative 10 volts; a process wherein the voltage resulting after contacting is from about a zero volts to about a negative 10 volts; a process wherein the voltage resulting after contacting is from about a negative 5 volts to about a negative 10 volts; a process wherein the voltage resulting after contacting is about a negative 10 volts; a process wherein the member is an ionographic member; a process wherein the member is a silicon carbide ionographic member; a process wherein the member is a photoconductive imaging member; a process wherein the member is a photoconductive imaging member comprised of a supporting substrate, a photogenerating layer, and a charge transport layer; a process wherein the aluminum complex is selected from the group consisting of hydroxy bis(3,5-di-tert-butyl salicylic)aluminate, hydroxy bis(3,5-di-tert-butyl salicylic)aluminate monohydrate, hydroxy bis(3,5-di-tert-butyl salicylic)aluminate dihydrate, hydroxy bis(3,5-di-tert-butyl salicylic)aluminate tri- or tetrahydrate, and mixtures; a process wherein the thermoplastic resin is ethylene vinyl acetate, the charge control additive is beta-cyclodextrin, and the aluminum complex is hydroxy bis(3,5-di-tert-butyl salicylic)aluminate; a process wherein the liquid is an aliphatic hydrocarbon; a process wherein the aliphatic hydrocarbon is a mixture of branched hydrocarbons with from about 12 to about 20 carbons atoms; a process wherein the aliphatic hydrocarbon is a mixture of normal hydrocarbons of from about 10 to about 20 carbon atoms; a process wherein the carbon black pigment is present in an amount of about 0.1 to 60 percent by weight based on the total weight of the solids of resin, pigment, and charge control additive; a process wherein the carbon black pigment is present in an amount of about 30 to about 50 percent by weight based on the total weight of the solids of resin, pigment, and charge control additive; a process wherein the composition possesses a solids content of from about 1 to about 5 weight percent, and which solids are comprised of thermoplastic resin, pigment, and charge control additive, and wherein said pigment is present in an amount of from about 30 to about 50 weight percent based on the weight of solids, the resin is present in an amount of from about 50 to about 70 weight percent based on the weight of solids, and the charge control additive is present in an amount of from about 1 to about 10 weight percent based on the weight of solids; a process wherein there is further included in the composition a charge additive of aluminum stearate; a process wherein the charge additive is a cyclodextrin; a process wherein the charge additive is a cyclodextrin and the charge director is hydroxy bis(3,5-di-tert-butyl salicylic)aluminate; a process for the reduction of residual image voltage present on an imaging member which comprises contacting the member with a liquid developer composition comprised of a nonpolar liquid, thermoplastic resin particles, charge control additive, carbon black pigment and a charge director; and a process wherein the charge director is a nonpolar liquid soluble organic aluminum complex, or mixtures thereof of the formulas

II.

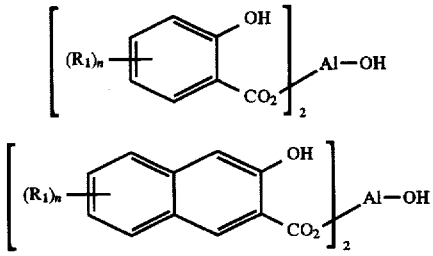

wherein $R_1$ is selected from the group consisting of hydrogen and alkyl, and n represents a number.

Embodiments of the invention will be illustrated in the following nonlimiting Examples, it being understood that these Examples are intended to be illustrative only and that the invention is not intended to be limited to the materials, conditions, process parameters, and the like recited herein. Comparative Examples and data are also presented.

CONTROL 1

Hilord Hibrite Black Ink (27287-96-1):

The above developer/ink is commercially available and was obtained from Hilord Inc.

EXAMPLES IA and IB

40 Percent of REGAL 330® Black Pigment; No CCA (27535-37-3):

One hundred sixty-two point zero (162.0) grams of ELVAX 200W® (a copolymer of ethylene and vinyl acetate with a melt index at 190° C. of 2.500 available from E. I. DuPont de Nemours & Company, Wilmington, Del.), 108.0 grams of the black pigment (Cabot REGAL 330®) and 405 grams of ISOPAR M® (Exxon Corporation) were added to a Union Process O1 attritor (Union Process Company, Akron, Ohio) charged with 0.1857 inch (4.76 millimeters) diameter carbon steel balls. The mixture was milled in the attritor, which was heated with running steam through the attritor jacket at 56° C. to 86° C. (Centigrade), for 2 hours. 675 Grams of ISOPAR G® were added to the attritor at the conclusion of the 2 hours, and the attritor was then cooled to 23° C. by running water through the attritor jacket, and mixing was continued in the attritor for an additional 2 hours. Additional ISOPAR G®, about 300 grams, was added, and the mixture was separated from the steel balls.

To 305.19 grams of the mixture (13.762 percent solids) were added 2.480.81 grams of ISOPAR G® (Exxon Corporation) and 14.0 grams of the charge director hydroxy bis(3,5-tertiary butyl salicylic)aluminate, (3 weight percent in ISOPAR M®) to provide a charge director level of 10 milligrams of charge director per gram of toner solids (Example IA). After print testing in the 8936 machine mentioned herein, another 7.0 grams of the charge director hydroxy bis(3,5-tertiary butyl salicylic)aluminate (3 weight percent in ISOPAR M®) were added to the Example IA developer to provide a charge director level of 15 milligrams of charge director per gram of toner solids (Example IB). The Example IB developer was then print tested in the same manner as the Example IA developer. The charge of the resulting liquid toner or developer after print testing was measured by the series capacitance method and was found to be 0.20 for the Example IA developer and 0.26 for the Example IB developer. The toner average by area particle diameter was 1.0 micron as measured with a Horiba Capa 700 particle size analyzer.

EXAMPLES IIA and IIB

40 Percent of REGAL 330® Black Pigment; 7 Percent of Beta-cyclodextrin CCA (27535-37-4):

One hundred forty-three point one (143.1) grams of ELVAX 200W® (a copolymer of ethylene and vinyl acetate with a melt index at 190° C. of 2.500 available from E. I. DuPont de Nemours & Company, Wilmington, Del.), 108.0 grams of the black pigment (Cabot REGAL 330®), 18.9 grams of the charge additive beta-cyclodextrin (America Maize Products Company), and 405 grams of ISOPAR M® (Exxon Corporation) were added to a Union Process O1 attritor (Union Process Company, Akron, Ohio) charged with 0.1857 inch (4.76 millimeters) diameter carbon steel balls. The mixture was milled in the attritor which was heated with running steam through the attritor jacket at 56° C. to 86° C. for 2 hours. 675 Grams of ISOPAR G® were added to the attritor at the conclusion of the 2 hours, and the attritor was cooled to 23° C. by running water through the attritor jacket, and thereafter, mixing and grinding in the attritor was accomplished for an additional 2 hours. Additional ISOPAR G®, about 300 grams, was added and the mixture was separated from the steel balls.

To 292.19 grams of the mixture (14.374 percent solids) were added 2.493.81 grams of ISOPAR G® (Exxon Corporation) and 14.0 grams of the Example IA charge director (3 weight percent in ISOPAR M®) to provide a charge director level of 10 milligrams of charge director per gram of toner solids (Example IIA). After print testing as in Example IA, another 7.0 grams of Alohas charge director (3 weight percent in ISOPAR M®) were added to the Example IIA developer to provide a charge director level of 15 milligrams of charge director per gram of toner solids (Example IIB). The Example IIB developer was then print tested in the 8936 in accordance with Example I, as the Example IIA developer. The charge of the resulting liquid toner or developer after the above print testing was measured by the series capacitance method and was found to be 0.30 for the Example IIA developer and 0.30 for the Example IIB developer. The toner average by area particle diameter was 1.0 micron as measured with a Horiba Capa 700 particle size analyzer.

EXAMPLES IIIA and IIIB

40 Percent of REGAL 330® Black Pigment; 5 Percent of Rhodamine Y Pigment CCA (27535-37-7):

One hundred forty-eight point five (148.5) grams of ELVAX 200W® (a copolymer of ethylene and vinyl acetate with a melt index at 190° C. of 2.500 available from E. I. DuPont de Nemours & Company, Wilmington, Del.), 108.0 grams of the black pigment (Cabot REGAL 330®), 13.5 grams of the magenta pigment (Sun Rhodamine Y 18:3), and 405 grams of ISOPAR M® (Exxon Corporation) were added to a Union Process O1 attritor (Union Process Company, Akron, Ohio) charged with 0.1857 inch (4.76 millimeters) diameter carbon steel balls. The mixture was milled in the attritor which was heated with running steam through the attritor jacket at 56° C. to 86° C. for 2 hours. 675 Grams of ISOPAR G® were added to the attritor at the conclusion of the 2 hours, and the attritor was cooled to 23° C. by running water through the attritor jacket, and thereafter, the mixture therein was mixed for an additional 2 hours. Additional ISOPAR G®, about 300 grams, was then added and the resulting mixture was separated from the steel balls.

To 285.07 grams of the mixture (14.733 percent solids) were added 2.500.93 grams of ISOPAR G® (Exxon Corporation) and 14.0 grams of aluminum charge director of Example I, (3 weight percent in ISOPAR M®) to give a charge director level of 10 milligrams of charge director per gram of toner solids (Example IIIA). After print testing in the 8936, another 7.0 grams of the aluminum Example I charge director (3 weight percent in ISOPAR M®) were added to the Example IIIA developer to provide a charge lo director level of 15 milligrams of charge director per gram of toner solids (Example IIIB). The Example IIIB developer was then print tested in the same manner as the Example IIIA developer. The charge of the resulting liquid toner or developer after print testing was measured by the series capacitance method and was found to be 0.35 for the Example IIIA developer and 0.41 for the Example IIIB developer. The toner average by area particle diameter was 1.0 micron as measured with a Horiba Capa 700 particle size analyzer.

The Xerox ColorgrafX System 8936 is a 36 inch wide multiple pass ionographic printer. The printer parameters were adjusted to obtain a contrast of 50 and a speed of 2.0 ips by inputting values on the control panel. After single pass prints were generated with the above parameter settings using the standard test printing mode (sail patterns), the residual development voltage was measured using an Electrostatic Volt Meter (Trek Model No. 565). This value is shown as residual voltage [($V_{out}$)]. This parameter is valuable primarily since it is a measurement used to predict the amount of undesired color shifting (also referred to as staining) of the developed toner layer upon subsequent development passes. The reflective optical density (ROD), a color intensity measurement of chroma, was measured with a Macbeth 918 color densitometer using the substrate paper background as a reference. The paper used to test print these images was Rexham 6262.

A series of measurements were accomplished with the following results:

For Control 1, which represented the commercial Hilord Hibrite developer materials, the reflective optical density was 1.26, and the residual voltage was 50.

For Example IA, which contained 40 weight percent of REGAL 330® black pigment and no CCA (charge control additive), and wherein the milligrams of charge director per gram of toner solids was 10/1 aluminum charge director, the total charge of the developer in microcoulombs was 0.20, the reflective optical density was 1.32, and the residual voltage was 5 volts.

For Example IB, which contained 40 weight percent of REGAL 330® black pigment and no CCA, and wherein the milligrams of charge director per gram of toner solids was 15/1 aluminum charge director, the total charge of the developer in microcoulombs was 0.26, the reflective optical density was 1.39, and the residual voltage was 5 volts.

For Example IIA, which contained 40 weight percent of REGAL 330® black pigment and 7 percent of beta-cyclodextrin CCA, and wherein the milligrams of charge director per gram of toner solids was 10/1 aluminum charge director, the total charge of the developer in microcoulombs was 0.20, the reflective optical density was 1.31, and the residual voltage was 5 volts.

For Example IIB, which contained 40 weight percent of REGAL 330® black pigment and 7 percent of beta-cyclodextrin CCA, and wherein the milligrams of charge director per gram of toner solids was 15/1 Alohas, hydroxy bis(3,5-tertiary butyl salicylic)aluminate, the total charge of the developer in microcoulombs was 0.25, the reflective optical density was 1.35, and the residual voltage was 5 volts.

For Example IIIA, which contained 40 weight percent of REGAL 330® black pigment and 5 percent of Rhodamine Y pigment as the CCA, and wherein the milligrams of charge director per gram of toner solids was 10/1 aluminum charge director, the total charge of the developer in microcoulombs was 0.35, the reflective optical density was 1.31, and the residual voltage was 5 volts.

For Example IIIB, which contained 40 weight percent of REGAL 330® black pigment and 5 percent of Rhodamine Y pigment as the charge control additive, and wherein the milligrams of charge director per gram of toner solids was 15/1, the total charge of the developer in microcoulombs was 0.41, the reflective optical density was 1.32, and the residual voltage was 5 volts.

The ratios 15/1, 10/1, and the like refer to the milligrams of charge director, such as 15, to 1 gram of toner solids.

For improved image quality in multilayered images, it is preferred that RODs increase, which increase permits more intense color or chroma, and $V_{outs}$ decrease, which decrease minimizes color staining or hue shifts of a black image after overcoating the black image with a cyan toner. The thickness of a developed layer, for example cyan, is dependent upon the charging level (proportional to applied voltage) on the dielectric receptor. Since a constant voltage is generally applied to the dielectric receptor in development of the layers in a multilayered image, large residual voltages, as might occur after development of the black layer, add to the applied voltage resulting in a thicker cyan layer. A thicker cyan layer overlaid on the thinner black layer will cause the latter to color shift. Review of the measurements and data presented herein indicates that use of the Hilord Hibrite black developer, Control 1, failed to increase reflective optical densities (ROD) and lower residual voltages ($V_{out}$) of the developed black images. REGAL 330® pigment, combined with a variety of CCAs, was 5 incorporated into the 8936 machine, Examples IA, IB, IIA, IIB, IIIA and IIIB black developers, and the resulting RODs of the developed images were substantially higher than the control RODs; 1.39, 1.36, 1.32 and 1.26 for Examples IB, IIB, IIIB and Control 1, respectively. In addition, the residual voltages were substantially lower for the REGAL 330® pigmented developers with respect to the Hilord Control; 5, 5, 5 and 50 for Examples IB, IIB, IIIB and Control 1, respectively. Therefore, the REGAL 330® pigmented developers resulted in higher RODs and lower residual voltages. The advantages thereof in view of, for example, the lower residual voltages indicated superior color strength and higher image stability to color shifting from overlaying of subsequent toning passes.

Other embodiments and modifications of the present invention may occur to those of ordinary skill in the art subsequent to a review of the information presented herein; these embodiments and modifications, and equivalents thereof, are also included within the scope of this invention.

What is claimed is:

1. A process for the reduction of residual image voltage present on an imaging member which comprises contacting the member with a composition comprised of a nonpolar liquid, thermoplastic resin particles, an optional charge adjuvant, charge control additive, carbon black pigment, and a charge director comprised of a nonpolar liquid soluble organic aluminum complex, or mixtures thereof of the formulas

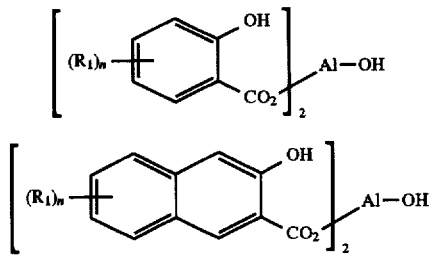

II wherein $R_1$ is selected from the group consisting of hydrogen and alkyl, and n represents a number, and wherein said voltage is reduced to from about zero to about 25 volts.

2. A process in accordance with claim 1 wherein the charge control additive is beta-cyclodextrin.

3. A process in accordance with claim 1 wherein the residual voltage is reduced from a negative 140 volts to from about zero volts to about a negative 10 volts.

4. A process in accordance with claim 1 wherein the voltage resulting after contacting is from about zero volts to about a negative 10 volts.

5. A process in accordance with claim 1 wherein the voltage resulting after contacting is from about a negative 5 volts to about a negative 10 volts.

6. A process in accordance with claim 1 wherein the voltage resulting after contacting is about a negative 10 volts.

7. A process in accordance with claim 1 wherein the member is an ionographic member.

8. A process in accordance with claim 1 wherein the member is a silicon carbide ionographic member.

9. A process in accordance with claim 1 wherein the member is a photoconductive imaging member.

10. A process in accordance with claim I wherein the member is a photoconductive imaging member comprised of a supporting substrate, a photogenerating layer, and a charge transport layer.

11. A process in accordance with claim I wherein the aluminum complex is selected from the group consisting of hydroxy bis(3,5-di-tert-butyl salicylic)aluminate, hydroxy bis(3,5-di-tert-butyl salicylic) aluminate monohydrate, hydroxy bis(3,5-di-tert-butyl salicylic)aluminate dihydrate, hydroxy bis(3,5-di-tert-butyl salicylic)aluminate tri- or tetrahydrate, and mixtures thereof.

12. A process in accordance with claim 1 wherein the thermoplastic resin is ethylene vinyl acetate, the charge control additive is beta-cyclodextrin, and the aluminum complex is hydroxy bis(3,5-di-tert-butyl salicylic) aluminate.

13. A process in accordance with claim 1 wherein the liquid is an aliphatic hydrocarbon.

14. A process in accordance with claim 13 wherein the aliphatic hydrocarbon is a mixture of branched hydrocarbons with from about 12 to about 20 carbons atoms.

15. A process in accordance with claim 13 wherein the aliphatic hydrocarbon is a mixture of normal hydrocarbons of from about 10 to about 20 carbon atoms.

16. A process in accordance with claim 1 wherein the carbon black pigment is present in an amount of about 0.1 to 60 percent by weight based on the total weight of the solids of resin, pigment, and charge control additive.

17. A process in accordance with claim 1 wherein the carbon black pigment is present in an amount of about 30 to about 50 percent by weight based on the total weight of the solids of resin, pigment, and charge control additive.

18. A process in accordance with claim 1 wherein the composition possesses a solids content of from about 1 to about 5 weight percent, and which solids are comprised of thermoplastic resin, pigment, and charge control additive, and wherein said pigment is present in an amount of from about 30 to about 50 weight percent based on the weight of solids, the resin is present in an amount of from about 50 to about 70 weight percent based on the weight of solids, and the charge control additive is present in an amount of from about 1 to about 10 weight percent based on the weight of solids.

19. A process in accordance with claim 1 wherein there is further included in the composition a charge additive of aluminum stearate.

20. A process in accordance with claim 1 wherein the charge additive is a cyclodextrin.

21. A process in accordance with claim 2 wherein the charge additive is a cyclodextrin and the charge director is hydroxy bis(3,5-di-tert-butyl salicylic)aluminate.

22. A process for the reduction of residual image voltage present on an imaging member which comprises contacting the member with a liquid developer composition comprised of a nonpolar liquid, thermoplastic resin particles, charge control additive, colorant and a charge director.

23. A process in accordance with claim 22 wherein the charge director is a nonpolar liquid soluble organic aluminum complex, or mixtures thereof of the formulas

II.

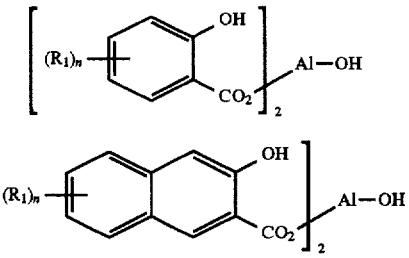

wherein $R_1$ is selected from the group consisting of hydrogen and alkyl, and n represents a number.

* * * * *